United States Patent [19]

Evenson

[11] Patent Number: 5,054,623

[45] Date of Patent: Oct. 8, 1991

[54] VERTICAL SORTER SYSTEM

[75] Inventor: Mel Evenson, San Pedro, Calif.

[73] Assignee: Eldon Industries, Inc., Inglewood, Calif.

[21] Appl. No.: 504,871

[22] Filed: Apr. 5, 1990

[51] Int. Cl.[5] ..... A47F 5/00

[52] U.S. Cl. ..... 211/11; 211/184

[58] Field of Search ..... 211/11, 10, 43, 2, 194, 211/126, 184, 55; 220/23.4, 23.83, 23.86

[56] References Cited

U.S. PATENT DOCUMENTS

| | | | |
|---|---|---|---|
| 1,772,438 | 8/1930 | Cubberley | 211/43 X |
| 2,902,166 | 9/1959 | Bahr | 211/11 |
| 4,429,796 | 2/1984 | Sussman | 211/11 |
| 4,480,745 | 11/1984 | Loge et al. | 220/23.4 X |

*Primary Examiner*—David M. Purol

*Attorney, Agent, or Firm*—Price, Gess & Ubell

[57] ABSTRACT

An improved vertical sorter system consisting of identical modules that can be coupled to one another in either an aligned front-to-front configuration or a variable position front-to-back configuration. The size of the overall vertical sorter system and the orientation of the modules relative to one another can be varied by the user as desired. The connecting components are integral with the modules such that no additional connecting components are required. The connecting components are hidden from view after the modules are coupled to one another.

6 Claims, 5 Drawing Sheets

VERTICAL SORTER SYSTEM

BACKGROUND OF THE INVENTION

1. Field of the Invention

The present invention generally relates to desk accessories commonly known as vertical sorters. More particularly, the present invention relates to a vertical sorter system comprised of individual modules that may be locked to one another in a variety of orientations.

2. Description of Relates Art

There are numerous desk accessories that are used to hold and/or sort letters, memos, invoices, etc. A vertical sorter is the type of desk accessory that typically has a base and a plurality of spaced vertical walls that extend upward from the base so as to define a plurality of sorting spaces therebetween.

Two early recognized problems in vertical sorters was the need to vary the number and size of the sorting areas defined by the vertical walls. One solution is to provide the user with the ability to add or remove vertical walls on a base of a fixed size. Such removable walls are typically fastened to the base with a channel sliding means of some kind so that the user can adjust the spaces defined by the vertical walls.

While a vertical sorter having removable and/or slidably adjustable walls is an improvement over the fixed wall type, the overall size of such vertical sorters is detrimentally limited to the size of the base.

Various modular vertical sorter systems have been developed to overcome the size constraints of the fixed bases. Most systems are cosmetically undesirable because they operate with external slots and tabs that are visible even after the modules have been joined.

One prior art vertical sorter system is comprised of modules that include a rectangular base, a vertical dividing wall extending upward from one long side of the base, and an L-shaped projection extending from the other long side of the base. The modules may be locked back-to-front with one another by placing the wall-side (back) of one module's base over the L-shaped projection (front) of another base. The modules could be locked front-to-front with one another by abutting the L-shaped projections of two modules against one another and by placing a locking member having a U-shaped cross-section and being of equal width to the base over the two L-shaped projections, effectively locking the two bases to one another.

While the method of connecting the modules of such a modular vertical sorter to one another are not visible and the user can vary the size of the vertical sorter system, there is considerable need for an improved modular sorter system. For example, it is desirable to do away with the extraneous, easily-broken or misplaced U-shaped locking member that must be used to lock the prior art modules together in a front-to-front orientation. Moreover, the above prior art modules can only be so joined together in such a way that the bases of the modules are aligned with one another. Hence, the prior art modules cannot be joined to one another with their bases staggered, a configuration that is desirable in many instances.

SUMMARY OF THE INVENTION

The present modular vertical sorter system offers a modular vertical sorter system that solves the above problems associated with the prior art vertical sorters.

Specifically, it is an object of the present invention to provide a vertical sorter system of variable size;

It is another object of the present invention to provide a variable size vertical sorter system that uses identical modules;

It is another object of the present invention to provide a variable size modular vertical sorter system that does not require additional components to lock or fasten the modules to one another;

It is another object of the present invention to provide a modular vertical sorter system where the modules may be coupled to one another without visual indication of the coupling method used;

It is another object of the present invention to provide a modular vertical sorter system where the modules may either be aligned with one another or staggered, as desired;

It is another object of the present invention to provide a modular vertical sorter system that is cost efficient to manufacture; and It is another object of the present invention to provide a modular vertical sorter system that is simple to assemble.

The present invention achieves the above objects by providing an improved vertical sorter system that includes at least two vertical sorter modules, each vertical sorter module having a base with a bottom, a top, a front side, and a back side, and a divider wall that extends vertically upward from the back side of the base, the improvement comprising a first integral means for coupling the vertical sorter modules to one another when the modules are placed front-to-front, and a second integral means for coupling the vertical sorter modules to one another when the modules are placed front-to-back, and so that the alignment of the two modules may be slidably varied.

BRIEF DESCRIPTION OF THE DRAWINGS

The just-summarized invention will now be described in detail in conjunction with the drawings, of which.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a modular vertical sorter system, the modules of which can be joined to one another in various orientations and without need for additional components.

Figure 1:
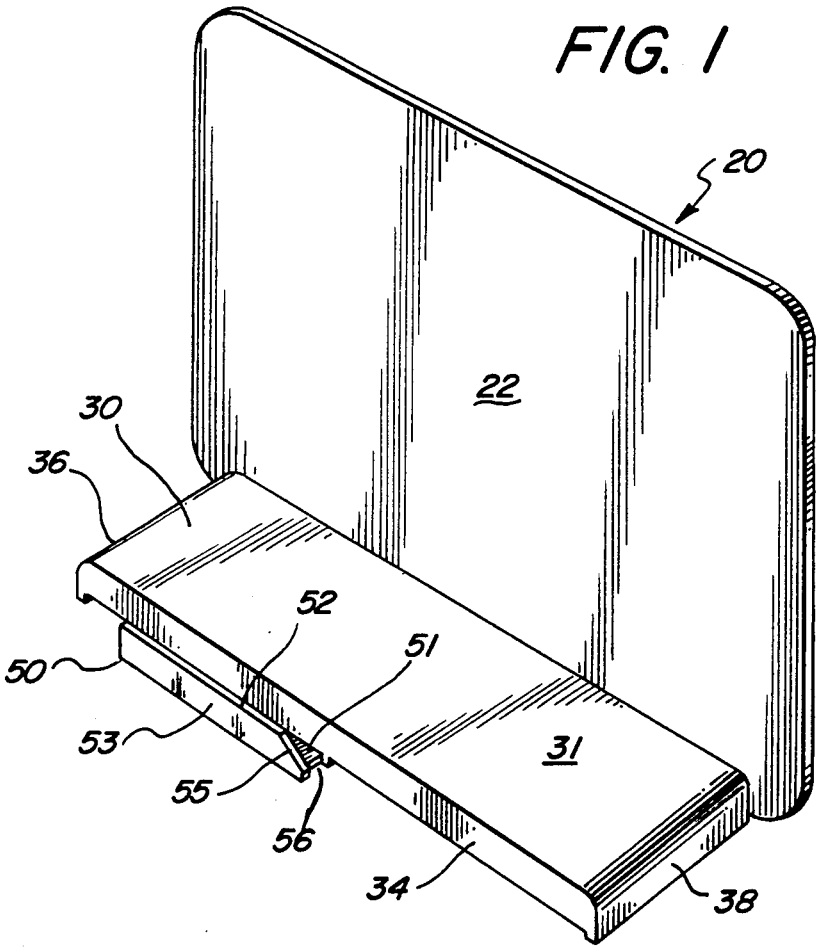
FIG. 1 is a perspective view of a vertical sorter module according to the present invention.

FIG. 1 illustrates a preferred embodiment of a module 20 that comprises the vertical sorter system of the present invention. In this preferred embodiment, the single module 20 shown in FIG. 1 may be adjoined with an identical module in either an aligned front-to-front orientation or an aligned or staggered back-to-front orientation. It can be seen from FIGS. 1 and 2 that the vertical sorter module 20 includes a substantially rectangular base 30 having a flat top side 31, a downwardly-extending front wall 34, a downwardly-extending back wall 35, and two downwardly-extending end walls 36, 38. A vertical divider wall 22 extends vertically upward from the back wall 35 of the base 30, and an L-shaped coupling flange 50 extends perpendicularly outward from the lower portion of the front wall 34 and to one side of its center. The vertical divider wall 35 could, of course, extend from other portions of the base 30.

Figure 2:
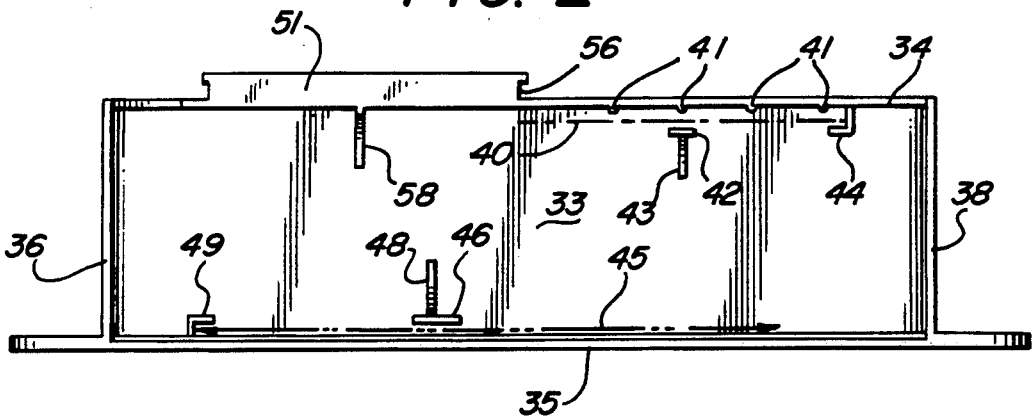
FIG. 2 is an underside plan view of the base of the module of FIG. 1 showing the projections that define the locking channel and the variable position channel.

The L-shaped coupling flange 50 is comprised of a horizontal extension portion 51 and a vertical tab portion 52. As shown in FIG. 2, a support member 58 helps to brace the L-shaped coupling flange 50. The vertical tab portion 52 is shown to have a front side 53, a back side 54 (see FIG. 7) that faces the front wall 34 of the base, and a diagonally sloped end 55. A horizontal notch 56 is defined by the diagonally sloped end 55 of the vertical tab portion 52 extending slightly beyond the horizontal base portion 51. The operation of this notch 56 will be explained further herein.

An object of the present invention is to provide a module that can be locked in either a front-to-front or back-to-front orientation with an identical module. FIG. 2 illustrates a recessed underside 33 of the base 30, the recessed underside being defined by the downwardly-extending walls 34, 35, 36, 38. As shown, various protrusions define two channels in which the vertical tab 52 of another module's L-shaped coupling flange 50 can be inserted. A locking channel 40 (shown by dashed lines ·'—·—) is generally defined by the front wall 34 of the base 30, channel guide 42, and an L-shaped end stop 44. The channel guide 42 is rigidly braced by support member 43. The locking channel 40 further includes a plurality of vertical ribs 41 that extend into the channel from the front wall 34. A variable position channel 45 (shown in dashed lines ··—··—··—) is generally defined by the back wall 35, a channel guide 46, and an L-shaped end stop 49. As with channel guide 42, channel guide 46 is also braced by a support member 48.

The operation of the locking channel will now be described with reference to FIGS. 3 through 7 and FIG. 10 Note that a numbering convention has been adopted where identical portions of individual vertical modules carry the same designating number, except that the designating numbers will vary by multiples of 100. For example, a first vertical module 20 has a vertical dividing wall 22, whereas a second vertical module 120 has a vertical dividing wall 122.

Figure 3:
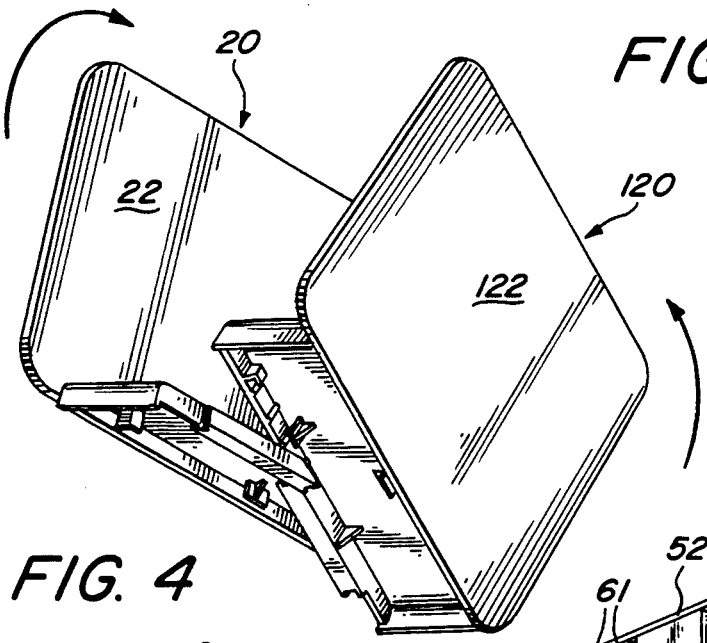
FIG. 3 is a perspective view of two vertical sorter modules being locked to one another in a front-to-front orientation where, the L-shaped extensions of each module are rotated into the corresponding locking channel of the other module.
Figure 4:
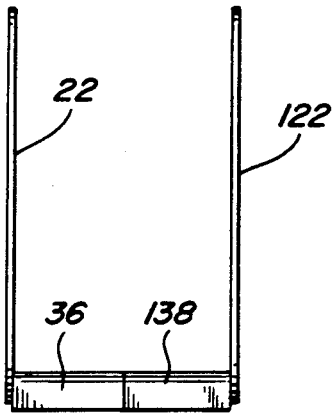
FIG. 4 is an end view of the vertical sorter modules of FIG. 3 after being fully rotated and locked to one another.
Figure 6:
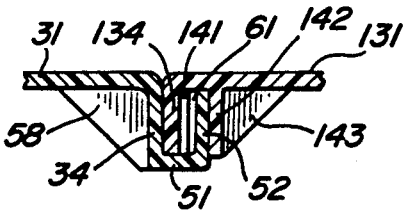
FIG. 6 is a cross-sectional view of FIG. 5 taken along lines 6—6 showing the L-shaped projection of one module adjoined with the locking channel of the other module.
Figure 5:
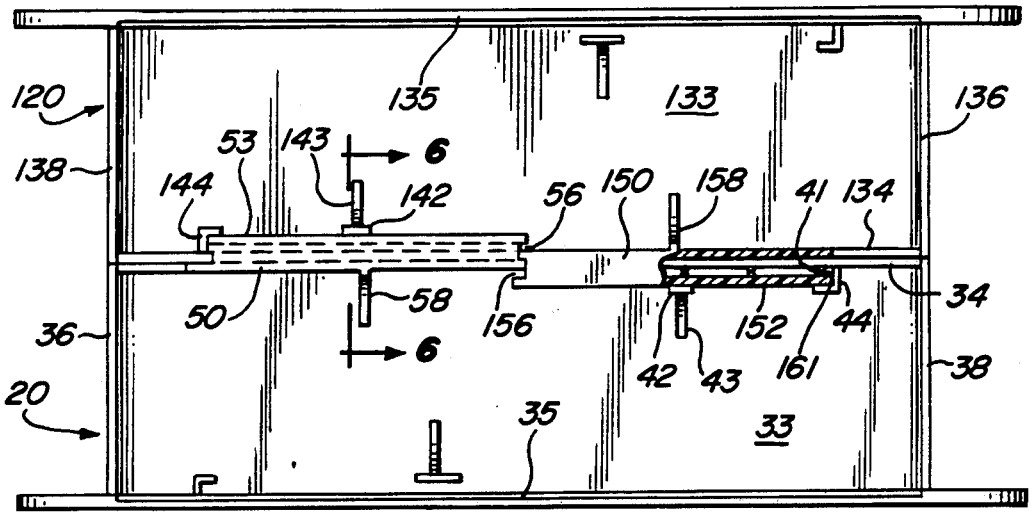
FIG. 5 is an underside plan view of the two modules of FIG. 3 after being locked to one another.
Figure 10:
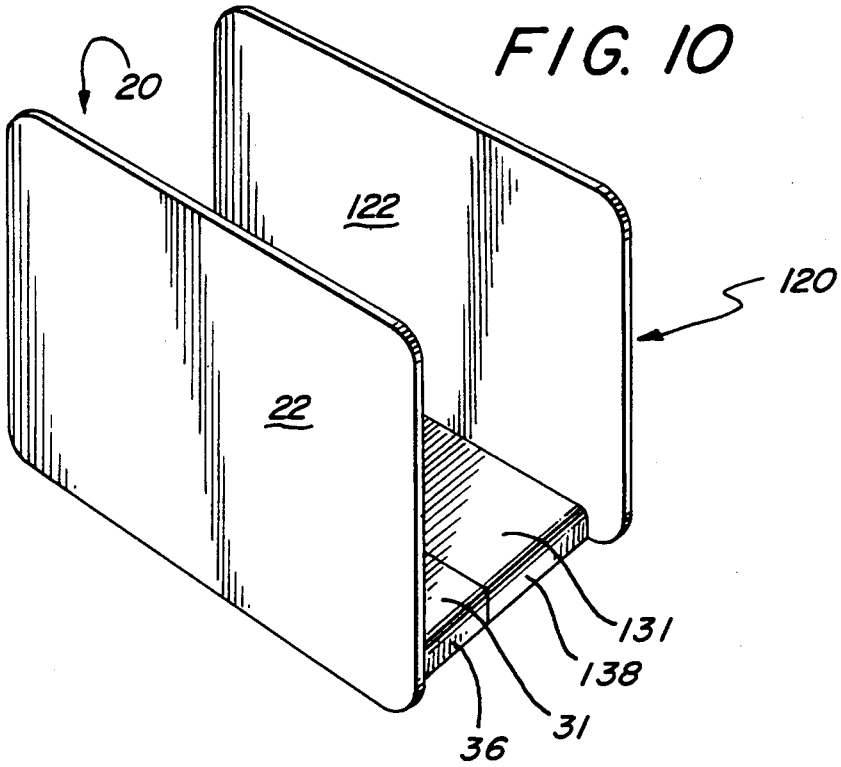
FIG. 10 is a perspective view of two modules joined to one another in a front-to-front orientation corresponding to FIGS. 3 through 5.

FIG. 3 illustrates two vertical modules 20, 120 being adjoined to one another in a front-to-front orientation. The two modules are joined to one another by angularly orienting the two modules with respect to one another and about their respective centers, by abutting the front walls 34, 134 in such a way that notch 56 of module 20 is engaged with notch 156 of module 120, and by rotating the modules as shown until the respective L-shaped coupling flanges 50, 150 of each module is inserted into the locking channel 40, 140 of the other module. Once this rotating step has occurred, the modules will be adjoined with one another as shown in FIGS. 4, 5, and 10.

Figure 7:
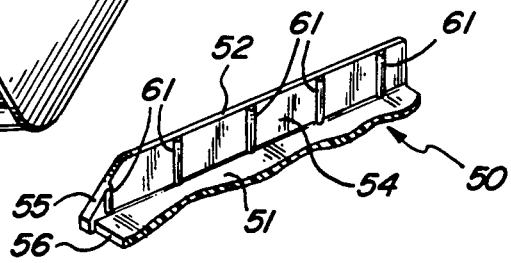
FIG. 7 is a perspective breakaway view of the inside of an L-shaped projection of one of the modules.

As best shown in FIGS. 2 and 7, a plurality of vertical ribs 41, 61 have been included in the locking channel 40 and on the interior side 54 of the coupling flange 50, respectively. After the two modules 20, 120 have been rotated and adjoined with one another, the vertical ribs 61 located on the coupling flange 50 of module 20 align with and abut the vertical ribs 141 located on the inside of the front wall 134 of the other module 120 (see FIGS. 5 and 6). The vertical ribs 41, 61, 141, 161 ensure a tight pressure fit between the coupling flange 50 (150) of one module and the locking channel 140 (40) of another module.

Figure 11:
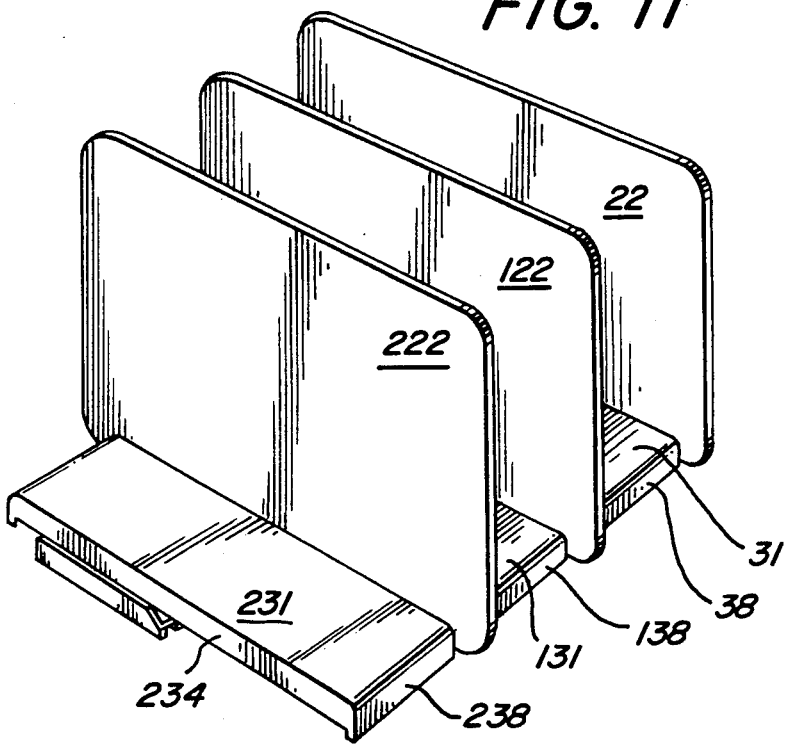
FIG. 11 is a perspective view of three modules joined to one another in an aligned back-to-front orientation corresponding to FIG. 8.

The vertical modules of the present invention may also beneficially be adjoined with one another in a back-to-front orientation. Unlike the prior art systems, the modules of the present invention are not limited to being locked to one another in an aligned fashion and may be either aligned or staggered, as shown in FIGS. 11 and 12, respectively.

The operation of the variable position channel will now be described with reference to FIGS. 8, 9, 11, and 12. Because the variable position channels 45, 145, 245, and 345 do not include vertical ribs (as in the locking channel), the coupling flange of an adjoining module can be beneficially inserted at various positions within the channel. The variable position channel beneficially allows the user to vary the degree to which individual modules are staggered with respect to one another. For example, some modules could be placed in an aligned back-to-front orientation, while other modules in the same series can be staggered from the aligned modules in varying degrees.

Figure 8:
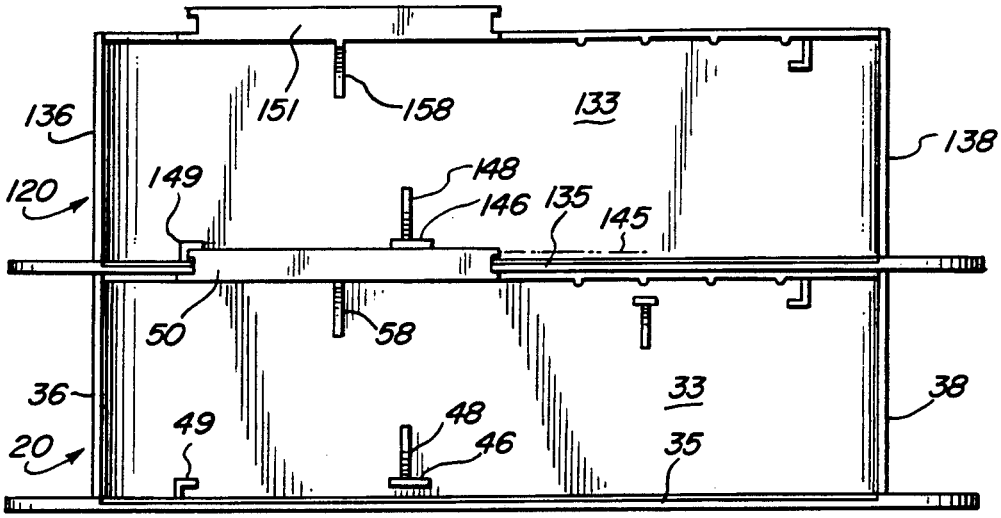
FIG. 8 is an underside plan view of two modules joined to one another in a back-to-front orientation with the L-shaped projection of one module adjoining the variable position channel of the other module.

FIG. 8 illustrates the underside of two modules 20, 120 joined back-to-front with one another. The modules 20, 120 are illustrated in an aligned configuration where the coupling flange 50 of module 20 is inserted into the left-most side of the variable position channel 145 of module 120 such that coupling flange 50 abuts the L-shaped end stop 149.

Figure 9:
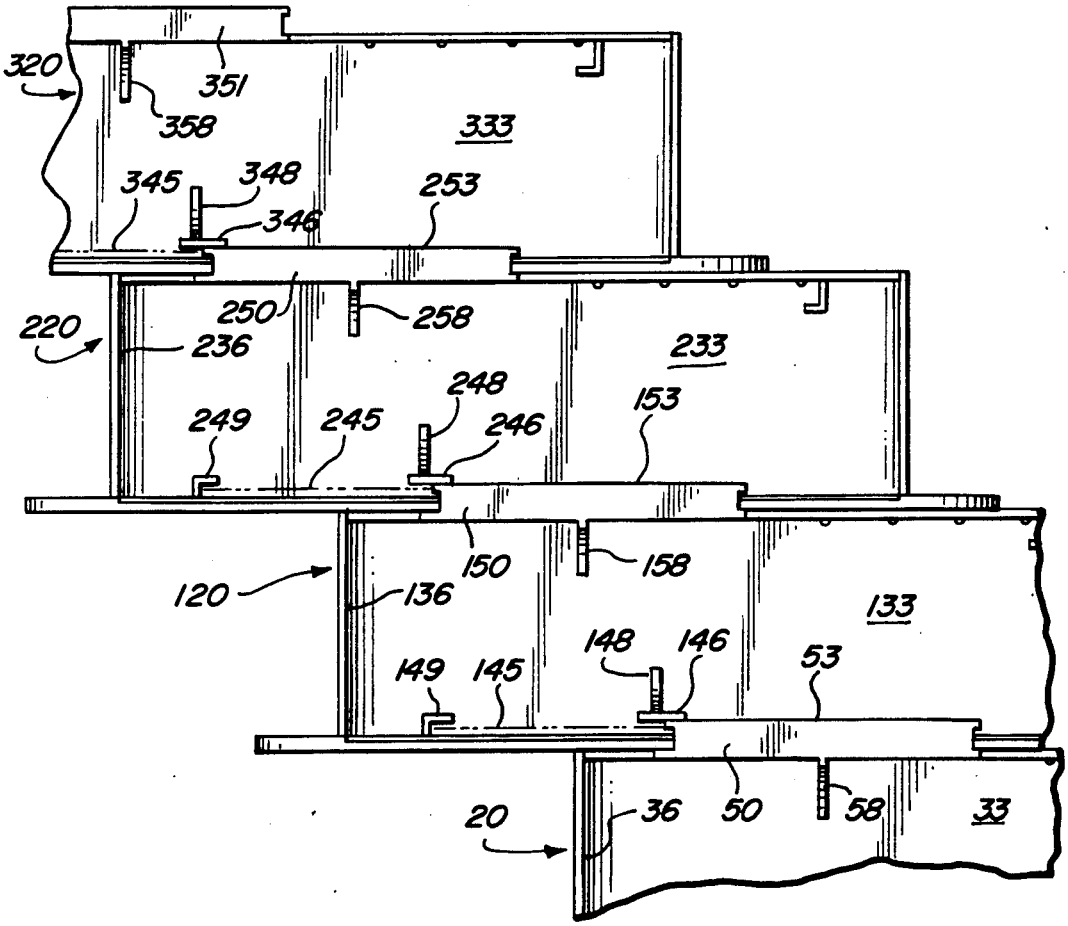
FIG. 9 is an underside plan view of four modules joined to one another in a staggered daisy chain back-to-front orientation.
Figure 12:
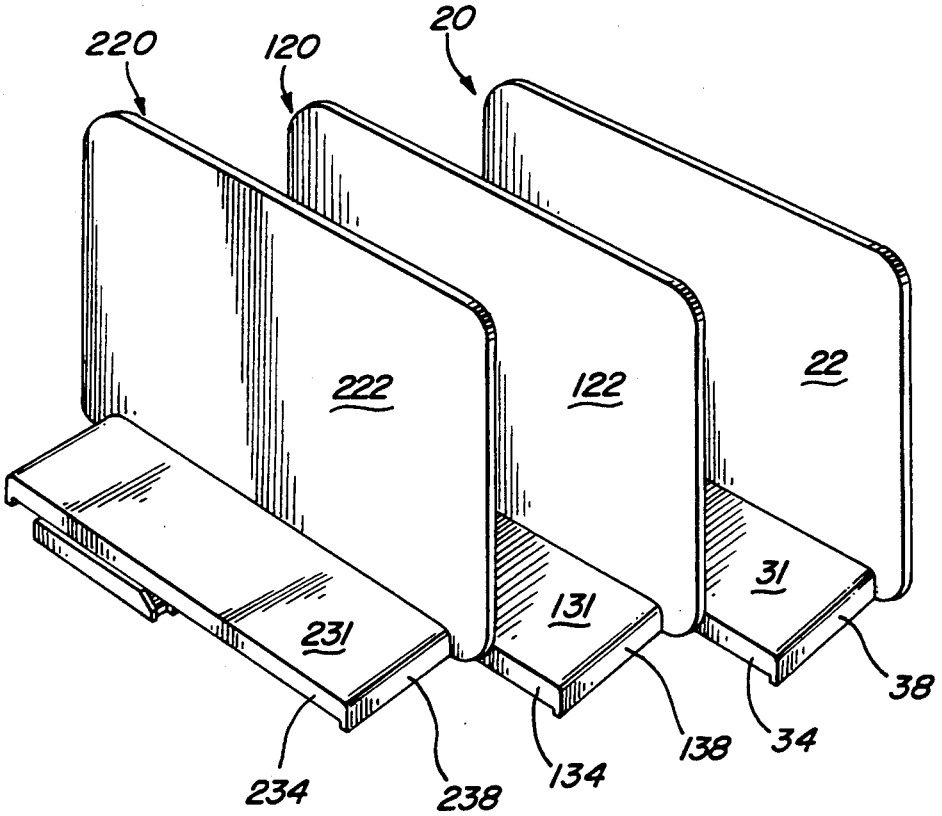
FIG. 12 is a perspective view of three modules joined to one another in a daisy chain staggered back-to-front orientation corresponding to FIG. 9.

FIGS. 9 and 12 illustrate a plurality of modules 20, 120, 220, and 320 that have been adjoined to one another in a staggered back-to-front orientation. As shown, the coupling flange 50 of module 20 has been inserted into the variable position channel 145 of module 120 in a spaced relationship with the L-shaped end stop 149 of module 120. A similar relationship exists between the coupling flange 150 of module 120 and the end stop 249 of module 220, as well as with the coupling flange 250 of module 220 and the end stop 349 (not shown) of module 320. The space between channel guide 46 and the back wall 35 is such that a light pressure fit exists between the variable position channel 45 and a coupling flange that has been inserted therein.

A series of two or more back-to-front modules would ordinarily be terminated with a single front-to-front connection. For example, the staggered series of modules 20, 120, and 220 shown in FIG. 12, can be terminated by adjoining a fourth module (not shown) in a front-to-front orientation with module 220 (see FIG. 10).

As will be apparent to those skilled in the art, various modifications and adaptations of the preferred embodiment may be made without departing from the scope and spirit of the invention. It is therefore understood that, within the scope of the appended claims, the invention may be practiced other than as specifically described herein.

What is claimed is:

1. A vertical sorter system that includes at least two vertical sorter modules, each vertical sorter module having a base with a bottom, a top, a front side, and a back side and a divider wall that extends vertically upward from the base, the back said module:

a first means for coupling the at least two vertical sorter modules in an aligned position relative to one another when the front sides of the bases of the at least two vertical sorter modules are coupled to one another; and a second means for coupling the at least two vertical sorter modules in variable positions relative to one another when the front side of one of the vertical sorter modules is coupled to the back side of the other vertical sorter module;

2. An improved first vertical sorter module that includes a base having a back side and a front side and a divider wall that extends vertically upward from the base, the improvement comprising:

a coupling means for coupling said first vertical sorter module to a second vertical sorter module in either a front-to-front or a front-to-back configuration, said coupling means being located on a first side of the center of the front side of the base;

a first cooperative coupling means for cooperatively coupling with the coupling means of the second vertical sorter module in the front-to-front configuration where the front side of the second vertical sorter module is coupled to the front side of said first vertical sorter module, said first cooperative coupling means being located at the front side and on a second side of the center of the base of said first vertical sorter module; and a second cooperative coupling means for cooperatively coupling with the coupling means of the second vertical sorter module in a front-to-back configuration where the front side of the second vertical sorter module is coupled to the back side of said first vertical sorter model, said second cooperative coupling means being located at the back side of the base of said first vertical sorter module.

3. The improved vertical sorter module of claim 2 wherein:

said coupling means comprises an elongated coupling flange that has a substantially L-shaped cross section, said coupling means longitudinally adjoining the front side of the base and extending perpendicularly outward therefrom; and said first cooperative coupling means comprises a first elongated channel that is capable of receiving the elongated coupling flange of the second vertical sorter module, said first elongated channel longitudinally adjoining the front side of the base;

whereby the front side of the second vertical sorter module may be coupled to the front side of said first vertical sorter module by virtue of said first elongated channel receiving the elongated coupling flange of the second vertical sorter module and the first elongated locking channel of the second vertical sorter module simultaneously receiving said elongated coupling flange.

4. The improved vertical sorter module of claim 2 wherein:

said coupling means comprises an elongated coupling flange that has a substantially L-shaped cross section, said coupling means longitudinally adjoining the front side of the base and extending perpendicularly outward therefrom; and said second cooperative coupling means comprises a second elongated channel that is capable of receiving the elongated coupling flange of the second vertical sorter module, said second elongated channel longitudinally adjoining the back side of the base;

whereby the front side of the second vertical sorter module may be coupled to the back side of said first vertical sorter module by virtue of said second elongated locking channel receiving the elongated coupling flange of the second vertical sorter module.

5. A vertical sorter system comprising at least first and second vertical sorter modules, each vertical sorter module comprising:

an elongated base having first and second distal ends, and further having a top side and a bottom side with a front wall, a back wall, and two end walls that extend downward from the top side so as to define a cavity in the bottom side of the rectangular base;

an elongated coupling flange with a substantially L-shaped cross section, said elongated coupling flange extending perpendicularly from and longitudinally adjoining the front side of the base from at or near its center to said first distal end; and a first elongated channel located in the cavity of the base and being capable of receiving the elongated coupling flange of another vertical sorer module, said first elonged channel longitudinally adjoining the front side of the base from at or near it center and extending towards said second distal end;

whereby the first and second vertical sorter modules may be joined in an aligned position with respect to one another by first placing the centers of the front side of each vertical sorter modules against one another while the vertical sorter modules are oriented at an angle with respect to one another and then rotating one of the vertical sorter modules with respect to the other until the first elongated channel of each vertical sorter module has received the elongated coupling range of the other vertical sorter module.

6. The vertical sorter system of claim 5 wherein the vertical sorter modules further comprise:

a second elongated channel located in the cavity of the base and being capable of receiving the coupling flange of another vertical sorter module at variable positions along its length, said second elongated channel longitudinally adjoining at least a fractional portion of the back side of the base;

whereby the first and second vertical sorter modules may be joined at variable positions relative to one another by placing the coupling flange of the first vertical sorter module into the second elongated channel of the second vertical sorter module.

* * * * *